US006525700B1

(12) United States Patent
Smith

(10) Patent No.: US 6,525,700 B1
(45) Date of Patent: Feb. 25, 2003

(54) MULTI-SEGMENT ALPHANUMERIC DISPLAY

(76) Inventor: Robert Smith, 3706 Woodburn Rd., Annandale, VA (US) 22003

( * ) Notice: Subject to any disclaimer, the term of this patent is extended or adjusted under 35 U.S.C. 154(b) by 0 days.

(21) Appl. No.: 09/305,020

(22) Filed: May 4, 1999

(51) Int. Cl.[7] ..... G09G 3/04

(52) U.S. Cl. ..... 345/34; 345/39; 345/82; 345/83

(58) Field of Search ..... 345/33, 34, 35, 345/32, 39, 44, 46, 82, 83

(56) References Cited

U.S. PATENT DOCUMENTS

| | | | | | |
|---|---|---|---|---|---|
| 3,945,001 | A | | 3/1976 | Shimakawa | 340/336 |
| 4,201,039 | A | | 5/1980 | Marion | 368/241 |
| 4,288,788 | A | | 9/1981 | Rogers et al. | 340/378.2 |
| 5,406,301 | A | | 4/1995 | Ravid | 345/34 |
| 5,537,415 | A | | 7/1996 | Miller et al. | 370/95.1 |
| 5,596,315 | A | | 1/1997 | Olds et al. | 340/825.03 |
| 5,619,209 | A | | 4/1997 | Horstein et al. | 342/352 |
| 5,633,623 | A | * | 5/1997 | Campman | 340/321 |
| 5,642,397 | A | | 6/1997 | Agbaje-Anozie | 379/57 |
| 5,644,326 | A | | 7/1997 | Lauzon et al. | 345/34 |
| 5,694,453 | A | | 12/1997 | Fuller et al. | 379/57 |
| 5,707,081 | A | | 1/1998 | Luna | 283/45 |
| 5,734,963 | A | | 3/1998 | Fitzgerald et al. | 455/31.2 |
| 5,737,688 | A | | 4/1998 | Sakai et al. | 455/31.2 |
| 5,781,539 | A | | 7/1998 | Tanaka | 370/312 |
| 5,784,685 | A | | 7/1998 | Stanford et al. | 455/31.2 |
| 5,812,102 | A | * | 9/1998 | Sprole, Jr. et al. | 345/34 |
| 5,952,985 | A | * | 9/1999 | McKinney et al. | 345/42 |
| 5,969,628 | A | * | 10/1999 | Andre' | 340/815.44 |
| 6,005,538 | A | * | 12/1999 | Hoekstra | 345/47 |
| 6,023,414 | A | * | 2/2000 | Fuji | 361/761 |
| 6,236,382 | B1 | * | 5/2001 | Kawakami et al. | 345/83 |

OTHER PUBLICATIONS

Sep. 1998, Brochure published by Sunshine Electronic Display Corporation.

* cited by examiner

*Primary Examiner*—Richard Hjerpe
*Assistant Examiner*—Kimnhung Nguyen
(74) *Attorney, Agent, or Firm*—Roberts Abokhair & Mardula, LLC

(57) ABSTRACT

A multi-segment alphanumeric display, such as a seven-segment display, is described. The display comprises a body including at least seven discreet segments. A lens to covers each of the segments. A bottom section comprising at least two light sources per segment is attached to the body. Electric circuitry is connected with the light sources in each segment for selective actuation of the segments. The segments in the body comprise partitioning of sufficient depth to prevent light bleeding from one segment to another.

16 Claims, 3 Drawing Sheets

MULTI-SEGMENT ALPHANUMERIC DISPLAY

BACKGROUND

The present invention generally relates to a digital display, and more specifically to a display that includes a plurality of segments, which are selectively energized to indicate a specific alphanumeric character.

In a conventional alphanumeric display, individual segments arranged in some predefined pattern are selectively energized to visually represent a desired character. The most common type of display includes at least seven separate segments arranged to visually represent a numeral eight if all the segments are simultaneously energized. Although this type of display can represent a limited number of alpha characters, it is most often employed to represent the numbers zero through nine. The same configuration can be used for both light emitting diode (LED) displays and liquid crystal displays (LCDs).

Most of these displays are utilized in equipment and apparatus where the displays are viewed from close proximity and from an angle of less than 45 degrees. Such displays are used on digital watches, alarm clocks, automotive dashboards, various gauges and the like. Such displays are not utilized for signs that are read from a distance or that require a wider angle of view.

For example, the art does not provide an adequate multi-segment display for utilization in a portable sign where the angle of view needs to be larger to increase the number of people that could read such a sign.

Accordingly, there is a need in the industry for a multi-segment display that has improved visibility, while at the same time is easy to operate with low power consumption.

SUMMARY

Accordingly, it is an object of the present invention to provide a multi-segment display device having improved visibility from both distance and view angle. Another objective of the invention is to provide a simple, easy to manufacture multi-segment display device with low power usage for use in various display signs.

The present invention comprises a multi-segment alphanumeric display comprising a body with at least seven discreet segments. In one embodiment of the present invention, the seven discreet segments are formed with partitions that extend substantially to the bottom of the body. The body is preferably of light color and smooth surfaces. The display further comprises a lens to cover each of the segments. Each lens preferably sits on the top of each segment fitting into a lip in the top part of the segment cavity. The surface of the lens is preferably flush with the body surface. In order to promote light diffusion from a light source, the lens preferably comprises a substantially flat outer surface and an irregular interior surface. The lenses are preferably of a different and darker color than the body. The bottom section attaches to the body and includes at least two light sources per segment. In one embodiment, the light sources are light emitting diodes. In order to promote visibility from a distance it is preferred that each segment comprise at least three diodes and more preferably at least four diodes. The depth of the multi-segment display is sufficient to eliminate hot spots when a segment is illuminated. The bottom section also includes the electric circuitry necessary to operate the alphanumeric display. It is preferable that the circuitry is 12 volt. The electric circuitry is connected to the light sources in each segment for selective actuation of the segments. The segments in the body comprise partitioning of sufficient depth to prevent light bleeding from one segment to another.

In one embodiment, the present invention relates to an improved numeric seven-segment display device for showing any single digit from 0 to 9. The body of the display comprises a top, a right-upper, a right-lower, a left-upper, a left lower, a middle and bottom discrete segments forming a figure-8 with essentially vertical sides and horizontal top, middle and bottom segments. The segments are covered with a lens fitting into a lip on the topside of the cavity forming each segment in the body of the display device. A bottom section attaches to the body and comprises at least two light sources per segment. Electric circuitry, preferably 12-volt circuitry, is connected to the light sources in each segment for selective actuation of the segments. The partitioning of the segments in the body is of sufficient depth to prevent light bleeding from one segment to another. Light emitting diodes are preferred light sources with at least three diodes per segment.

The display body is sufficiently deep in separating the light sources from the lenses to eliminate hot spots in any segment while actuated.

The display of the present invention has a visibility range greater than 100 feet and a visibility angle greater than 90 degrees. In one embodiment, the display has a visibility range greater than 200 feet and a visibility angle of approximately 120 degrees.

DRAWINGS

The foregoing aspects and many of the attendant advantages of this invention will become more readily appreciated as the same becomes better understood by reference to the following detailed description, when taken in conjunction with the accompanying drawings.

DESCRIPTION

Figure 1:
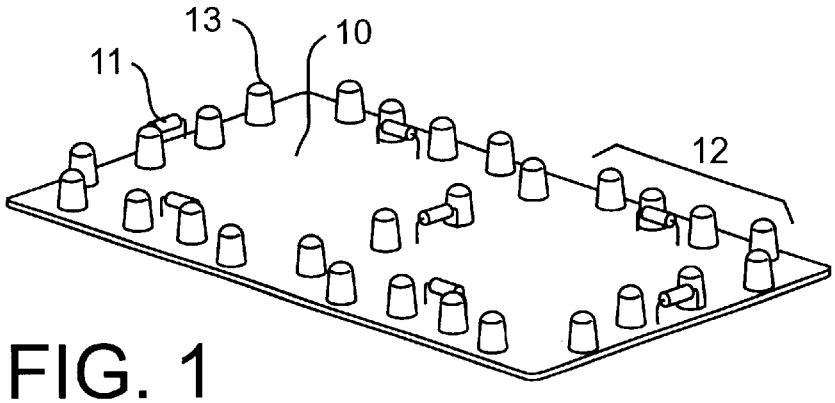
FIG. 1 shows a bottom section of the multi-segment display in accordance with one embodiment of the present invention.

The present invention provides an alphanumeric display mainly for utilization with large signs. These signs are utilized either indoors or outdoors to display short messages such as the value of a lottery jackpot. Whether utilized in a convenience store, service station, attached to a public transportation bus, or on top of a taxi cab, any sign comprising the multi-segment display of the present invention has to be visible from longer distances and remain clear through a wider view angle.

The present invention comprises a multi-segment alphanumeric display comprising a body with at least seven discreet segments. The body represents the major part of the device. Since these display devices are intended for large signs, the dimensions are too large to use on smaller devices such as wrist watches and home appliances. In one embodiment, the body of the multi-segment display is about two inches deep, three inches wide and six inches tall. One device is 2¾ inches deep, 3¾ inches wide and 6¼ inches tall. The dimensions depend on the size of the eventual sign incorporating these displays.

In one embodiment of the present invention, the seven discreet segments are formed with partitions that extend substantially to the bottom of the body. The body may be solid with the segments carved out, or may be hollow with partitions to separate the various segments. The partitions should extend from the top of the body to a point below the point where the light from any light source can bleed from one segment to the other. It is preferred that the partitions extend all the way through the body. This prevents any light bleed from one segment to the other resulting in crisper display and better distinction between the actuated and the non-actuated segments. The body is preferably of light color and smooth surfaces. The smooth interior surface reflects the light from the light source to the lenses. The light color assists in highlighting the lenses and adds to the visibility of the display. Lenses are utilized to cover the cavities of the segments in the body. The lens preferably fits flat with the surface of the body. Thus, a lip in the upper cavity for each segment is included as a seat for the lens. The lens surface can be above the surface of the body of the device but should not be below. If the lens surface is below the body surface, visibility is adversely affected.

In order to promote light diffusion from a light source, the lens preferably comprises a substantially flat outer surface and an irregular interior surface. The outer surface does not have to be smooth or absolutely flat. The key is that the surface should maximize visibility from a wider angle and for a longer distance. The interior or bottom surface is preferably not flat. For example, the lower interior surface has evenly distributed raised spherical nodes. Another option is raised cylindrical rows. The lens surface shape technology can be borrowed from the automotive industry. The automotive industry utilizes similar shapes for lenses covering brake lights and signal lights.

The lenses are preferably of a different and darker color than the body. An acceptable and preferred color is red. Any shade of red is preferred. Other bright colors may also be utilized for the lenses. It has been shown that yellow colors also provide good visibility. In one embodiment of the invention, the segments are visible even when not actuated. In a seven-segment format, the figure 8 of the unlit display is visible and clear at close up ranges. However, when actuated or lit, the segments are clearly distinguishable from the unlit segments even though the unlit segments remain visible. In another embodiment, the surface of the body and the lenses are close in color and the segments are not distinguishable unless actuated or lit. However, the contrasting colors are preferred.

The bottom section attaches to the body and includes at least two light sources per segment. The bottom section also serves as the board for mounting the desired circuitry. The bottom section or board can be solid or perforated. The power and controller leads are preferably attached to the bottom section or board. In one embodiment, the power and control means are connected to the board in one eight pin (telephone type) connector sometimes referred to as an RJ 45 input connector.

Various light sources can be utilized. Preferably, the light source has long life, utilizes lower energy and provides sufficient light for the application. Lower heat generation is also desirable. Since the segment partitions extend through the whole body of the display, a directional light is not necessary but is preferable. If the partitions do not extend through the whole body, a directional light is needed to prevent light bleed from one segment to the other. In a referred embodiment, the light sources are light emitting diodes (LEDs). For example, LEDs from Lumex are utilized. These high intensity LEDs have a life average of 100,000 hours (about 11 years) and a field of view of 29 degrees and an output of 3,000 MCD. It should be noted that the field of view of the display is greater than the field of view of the LEDs. The distance between the light source and the lens is important and should be sufficient to reduce hot spots from the lit segments. Hot spots are defined as the ability to clearly note that more than one light source is utilized in each segment when such segment is actuated. The light source should be of sufficient intensity to provide a lit display with improved visibility. LEDs are mentioned as the preferred source and as such more than one is needed per segment. This is the best economic configuration at present. However, it is contemplated that one light source that can distribute the light over the segment can be utilized.

In order to promote visibility from longer distances, it is even more preferred that each segment comprise at least three diodes and more preferably four or five diodes. The depth of the multi-segment display is sufficient to eliminate hot spots when a segment is illuminated. The diodes are preferably evenly distributed in any one segment.

The bottom section also includes the electric circuitry necessary to operate the alphanumeric display. It is preferable that the circuitry is 12 volt. The electric circuitry is connected to the light sources in each segment for selective actuation of the segments. It is contemplated that these multi-segment displays are incorporated into signs that are displayed on automobiles or public buses. Thus the 12 volts circuitry becomes important and allows the operation of the sign from the automobile's standard battery. Various power sources and control circuitry are well known and can be employed in the invention. For example, the control circuitry can allow individual manual control, group control, automatic control (for example time display), remote control and the like.

In another embodiment, the present invention relates to an improved numeric seven-segment display device for showing any single digit from 0 to 9. The body of the display comprises a top, a right-upper, a right-lower, a left-upper, a left lower, a middle and bottom discrete segments forming a figure-8 with essentially vertical sides and horizontal top, middle and bottom segments. The segments are covered with a lens fitting into a lip on the topside of the cavity forming each segment in the body of the display device. A bottom section attaches to the body and comprises at least two light sources per segment. Electric circuitry, preferably 12 volt circuitry, is connected to the light sources in each segment for selective actuation of the segments. The partitioning of the segments in the body is of sufficient depth to prevent light bleeding from one segment to another. Light emitting diodes are preferred light sources with at least three diodes per segment.

The display body is sufficiently deep in separating the light sources from the lenses to eliminate hot spots in any segment while actuated.

The display of the present invention has a visibility range greater than 100 feet and a visibility angle greater than 9.0 degrees. In one embodiment, the display has a visibility range greater than 200 feet and a visibility angle of approximately 120 degrees.

FIG. 1 shows the bottom section or board 10 in accordance with one embodiment of the invention. The LEDs 13 are arranged in groups of four diodes 12 per segment. Other circuitry components such as resistors 11 can be mounted on the board.

Figure 2:
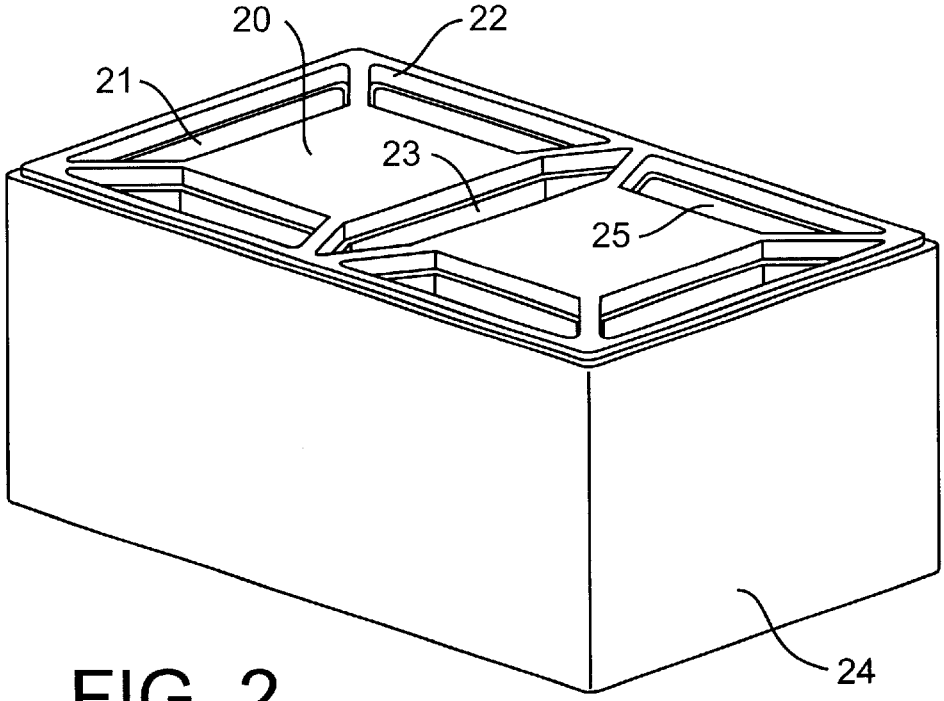
FIG. 2 shows a body section of the multi-segment display in accordance with one embodiment of the present invention.
Figure 5:
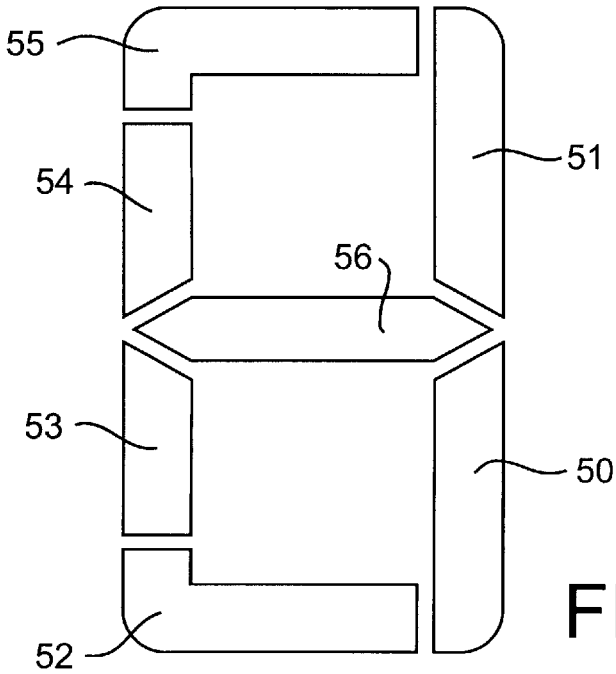
FIG. 5 shows a seven-segment configuration of a multi-segment display in accordance with one embodiment of the present invention.

FIG. 2 shows the body 20 of a seven-segment display in accordance with one embodiment of the invention. Segment cavities, such as 21 and 25 are shown. The outside segments can be of various shapes such as shown in FIGS. 2 and 5. The middle segment 23 may be of same or different shape compared to the outside segments. An indentation or lip 22 is located on the top surface of each segment cavity where a corresponding lens fits. Each of the segment cavities 21, shown in FIG. 2, extends from the top all the way to the bottom of the body 20. The embodiment shown in FIG. 2 results in a seven-segment display of about 2¾ inches deep, 3¾ inches wide, and 6¼ inches tall. The dimensions can vary in accordance with the application. However, the depth of the display should be sufficient to reduce hot spots. As an illustration, diodes 12 illuminate segment 25.

Figure 3:
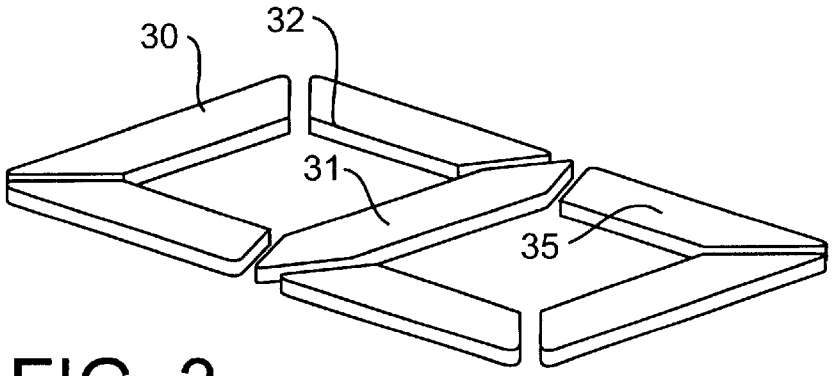
FIG. 3 shows the lenses that would fit the segments in the body section of one embodiment of the present invention as shown in FIG. 2.

FIG. 3 relates to a set of lenses that fit the body shown in FIG. 2. Lens 32 fits into the upper right cavity of FIG. 2 on lip or indentation 22. Lens 35 covers segment 25 over diodes 12. In this embodiment, lens 31 is of different shape than the exterior lenses. Since some of these alphanumeric displays are used outdoors, the lens installation optionally includes weather proofing. For example, gaskets are utilized in fitting lens 35 into segment 25. Other means include the utilization of weatherproof adhesives. Additionally, the makeup of the lens material 35 and the segment 25 can be such that the fit provides a weatherproof seal without the addition of gaskets or adhesives.

Figure 4A:
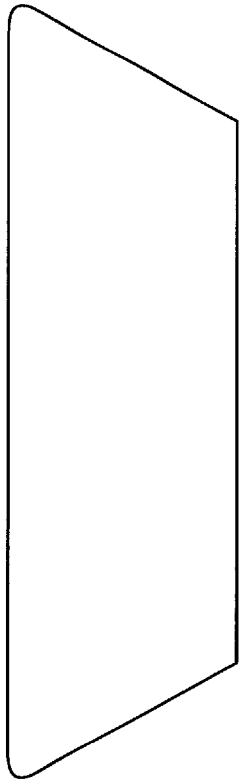
FIG. 4 shows various configurations of the bottom or interior side on a lens of a multi-segment display in accordance with one embodiment of the present invention.
Figure 4B:
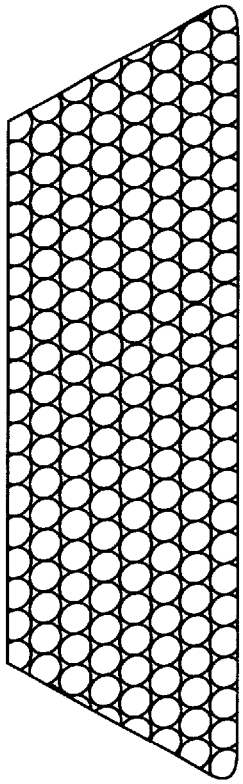
Figure 4C:
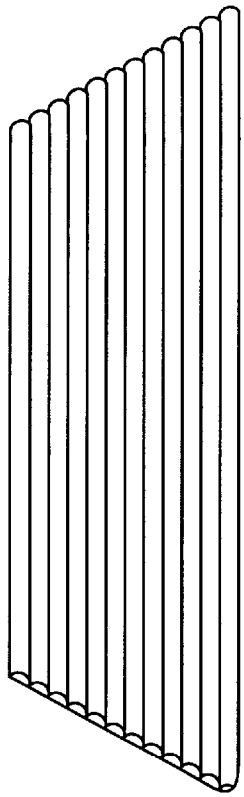

FIG. 4 shows various embodiments for the lenses. FIG. 4*a* shows a relatively flat outside surface of the lenses, such as lens 30. The shape of the lens conforms to the shape of the segment cavity in the body. FIG. 4*b* shows the underside of a lens in accordance with one embodiment of the invention. In this embodiment, the underside of each lens comprises rows of raised nodules. These nodules are preferably partially spherical. The nodules help to diffuse the light from the light source. FIG. 4*c* shows another embodiment wherein the underside of each lens comprises cylindrical ridges for improved light diffusion. Other irregular lower surfaces for the lenses are applicable. The intended result is improved light diffusion compared to flat surfaces.

FIG. 5 shows another embodiment of the present invention. The shape of the segments, and thus the lenses, is varied from FIG. 2. In this embodiment, lenses 55 and 52 wrap around the corner of the FIG. 8 display. Segments and lenses 53 and 54 are shorter than opposite segments 50 and 51. Middle lens 56 is a different shape than any of the others.

It is preferable that the depth of the display is greater than two inches, with the width greater than or equal to three inches, and the height equal to or greater than six inches.

Figure 6:
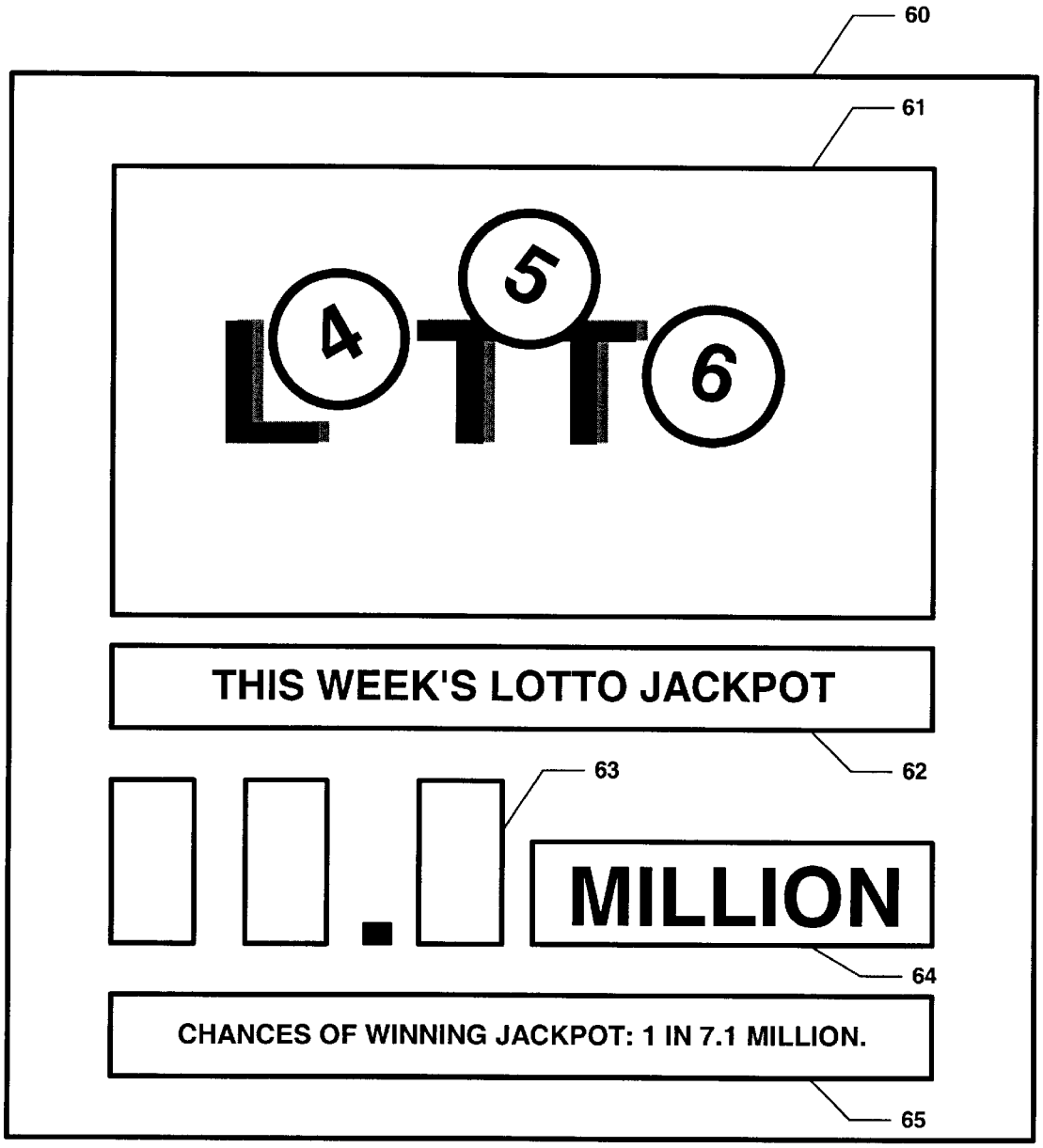
FIG. 6 shows a lottery display sign utilizing three multi-segment displays in accordance with one embodiment of the present invention.

FIG. 6 shows an application of one embodiment of the present invention. A lottery display sign 60 is shown having dimension of about twenty four inches in height, thirty five inches in width, and three and one half (3.5) inches in depth. The lottery sign 60 has a section 61 with fixed indicia including a logo with some design. Section 62 is another fixed indicia with a description to the values displayed on the multi-segment displays 63. As can be seen, three multi-segment displays are utilized to show the lottery jackpot value in millions of dollars. Section 64 displays the unit of measure for the numbers shown in segments 63. Section 65 is utilized for other fixed comments. The only variable on the sign is the value displayed in the multi-segment displays 63. Everything else is fixed. This sign could have the same or different display on the other side. As such, more multi-segment displays are utilized for the other side (back side). The location of these additional multi-segment displays is different than the location for the front side displays because the thickness of the multi-segment displays controls the minimum thickness of the overall sign.

These and other modifications to the preferred embodiment disclosed above will be apparent to those of ordinary skill in the art. Accordingly, it is not intended that the present invention in any way be limited by the disclosure, but instead that the scope be determined by reference to the claims that follow.

The embodiments of the invention in which an exclusive property or privilege is claimed are defined as follows:

1. A multi-segment alphanumeric display comprising:

a body comprising a planar surface with at least seven discreet segments with cavities, a lens to cover each of the segments, a bottom section comprising at least two light sources per segment, and electric circuitry connected with the light sources in each segment for selective actuation of the segments;

wherein the segment cavities in the body comprise partitioning of sufficient depth to prevent light bleeding from one segment to another;

wherein each segment cavity comprises a lip near the top of the cavity wherein each lens for each segment fits on the segment in the lip and a planar surface of each lens is flush with the planar surface of the body; and wherein the lenses are a darker reddish in color, the body is of a different lighter color to allow lenses of unlit segments to be visible from a distance of 100 feet, and the light sources are high intensity light emitting diodes.

2. The display of claim 1 wherein the light source is a light emitting diode and wherein each segment comprises at least 3 diodes.

3. An improved numeric seven-segment display device for showing any single digit from 0 to 9, comprising a body comprising a planar surface with a top, a right-upper, a right-lower, a left-upper, a left lower, a middle and bottom discrete segments forming a figure-8 with essentially vertical sides and horizontal top, middle and bottom segments wherein each segment includes a cavity, a lens to cover each of the segment cavities, a bottom section comprising at least two light sources per segment, and electric circuitry connected with said light sources in each segment for selective actuation of the segments;

wherein the segment cavities in the body further comprise partitioning of sufficient depth to prevent light bleeding from one segment to another;

wherein each segment in the body further comprises a lip near the top of the cavity to hold the lens, wherein each lens for each segment fits on the segment on the lip such that a planar outer surface of each lens is flush with the planar surface of the body; and wherein the lenses are a darker reddish in color, the body is of a different lighter color to allow lenses of unlit segments to be visible from a distance of 100 feet, and the light sources are high intensity light emitting diodes.

4. The display of claim 3 wherein the light sources are light emitting diodes.

5. The display of claim 4 wherein the bottom section comprises four light emitting diodes per segment.

6. The display of claim 3 wherein the body is sufficiently deep in separating the light sources from the lenses to eliminate hot spots in any segment while actuated.

7. The display of claim 3 wherein the electric circuitry is a 12 volts circuitry.

8. The display of claim 3 having a visibility range greater than 100 feet and a visibility angle greater than 90 degrees.

9. The display of claim 3 having a visibility range greater than 200 feet and a visibility angle of approximately 120 degrees.

10. The display of claim 3 wherein the lenses have an irregular under surface improving light diffusion from the light sources.

11. The display of claim 3 wherein the lenses have an under surface having raised nodes.

12. The display of claim 3 wherein the partitioning in the body extends from the top of the body substantially to the bottom section.

13. The display of claim 3 wherein the body is whitish in color and the lenses are reddish in color.

14. The display of claim 3 having dimensions of about 2 inches in depth, 3 inches in width and 6 inches in height.

15. An improved numeric seven-segment display device for showing any single digit from 0 to 9, comprising a light colored body having smooth surfaces and comprising a top, a right-upper, a right-lower, a left-upper, a left lower, a middle and bottom discrete segments forming a figure-8 with essentially vertical sides and horizontal top, middle and bottom segments, wherein each segment has a cavity and further comprises a lip near the top of the cavity, a dark colored lens of a color different from said body to allow lenses of unlit segments to be visible from a distance of 100 feet, said lens having a substantially flat outer surface to cover each of the segments fitting on the lip of each segment, wherein each lens is at least flush with the surface of the body.

a bottom section comprising at least three light emitting diodes per segment, and 12-volt electric circuitry connected with said diodes in each segment for selective actuation of the segments;

wherein the segment cavities in the body further comprise partitioning of sufficient depth to prevent light bleeding from one segment to another.

16. A display sign comprising at least one numeric seven-segment device of claim 15.

* * * * *